United States Patent [19]

Holroyd et al.

[11] Patent Number: 4,520,782

[45] Date of Patent: Jun. 4, 1985

[54] FUEL PUMPING APPARATUS

[75] Inventors: Ralph Holroyd, Dearborn Heights; Peter O. Spiller, Sterling Heights, both of Mich.

[73] Assignee: Lucas Industries Limited, Birmingham, England

[21] Appl. No.: 353,182

[22] Filed: Mar. 1, 1982

[30] Foreign Application Priority Data

Apr. 10, 1981 [GB] United Kingdom ..... 8111295

[51] Int. Cl.[3] ..... F02M 39/00

[52] U.S. Cl. ..... 123/450; 123/387; 417/462

[58] Field of Search ..... 123/450, 387, 385; 417/462

[56] References Cited

U.S. PATENT DOCUMENTS 4,055,387 10/1977 Potter ..... 123/450
4,098,249 7/1978 Mowbray ..... 123/450
4,187,822 2/1980 Craven ..... 123/450
4,200,072 4/1980 Bailey ..... 123/450
4,362,141 12/1982 Mowbray ..... 123/450
4,387,683 6/1983 Eheim ..... 123/387

*Primary Examiner*—Carl Stuart Miller
*Attorney, Agent, or Firm*—Holman & Stern

[57] ABSTRACT

A fuel pumping apparatus for supplying fuel to an internal combustion engine includes a throttle member having a groove which can register with a port to control the fuel flow to an injection pump forming part of the apparatus. The throttle member is angularly movable by a governor and is also axially movable. The groove has an inclined edge so that the variation in the axial setting will also control the fuel flow. A pivotal lever has one end engaging the throttle member and its other end mounts a cam follower which engages with a cam surface formed on a cam ring which is part of the injection pump and which is angularly movable in accordance with the speed of the engine. As the speed varies so also does the axial setting of the throttle member.

13 Claims, 3 Drawing Figures

FUEL PUMPING APPARATUS

BACKGROUND OF THE INVENTION

1. Field Of The Invention

This invention relates to a liquid fuel injection pumping apparatus for supplying fuel to internal combustion engines and of the kind comprising a body part, a bore, and a plunger reciprocable in the bore, a cam ring in the body part and having a cam lobe for imparting inward movement to the plunger to discharge fuel to an outlet, a low pressure pump for supplying fuel to said bore during the filling stroke of the apparatus, and valve means for controlling the outlet pressure of the pump so that it varies in accordance with the speed at which the apparatus is driven, a fluid pressure operable device responsive to the outlet pressure of the pump for controlling the angular setting of said cam ring, an angularly adjustable throttle member mounted in a drilling in the body part, a groove on the throttle member and a port opening into the drilling, said port and drilling constituting part of the flow path for fuel between the outlet of the pump and said bore and the degree of registration of the groove and the port being varied by altering the angular setting of the throttle member thereby to vary the quantity of fuel supplied to the bore.

2. Description Of The Prior Art

An example of such an apparatus is described in the specification of British Pat. No. 1171791 in which the throttle member is connected to a mechanical governor so as to be movable angularly thereby to control the quantity of fuel which is supplied to the bore. The throttle member is provided with an axial groove which communicates with the outlet of the pump. In order to provide an independent control of the maximum flow of fuel the throttle member is axially movable in the bore and for this purpose it is subjected to the outlet pressure of said pump. Moreover, the throttle member carries an arm which defines an inclined stop surface for engagement by a stop member and the arrangement is such that as the member is moved axially by an increasing outlet pressure, the throttle member will be forced to move angularly thereby altering the quantity of fuel supplied to the bore. The throttle member is biased by a spring against the force exerted by the outlet pressure of the pump and since the outlet pressure varies with speed so the maximum fuel delivery will vary with speed.

BRIEF SUMMARY OF THE INVENTION

The object of the present invention is to provide an apparatus of the kind specified in a simple and convenient form.

According to the invention in an apparatus of the kind specified the groove or at least one side edge thereof is inclined to the axis of the drilling whereby the degree of registration of the groove with the port will vary as the axial position of the throttle member is varied, the apparatus including a pivotal lever one end of which serves as a stop to control the axial setting of the throttle member, the other end of the lever engaging a cam follower which engages a cam surface formed on the cam ring whereby the axial setting of the throttle member can be varied by angular movement of the cam ring.

BRIEF DESCRIPTION OF THE DRAWINGS

An example of an apparatus in accordance with the invention will now be described with reference to the accompnaying drawings wherein.

DETAILED DESCRIPTION

Figure 1:
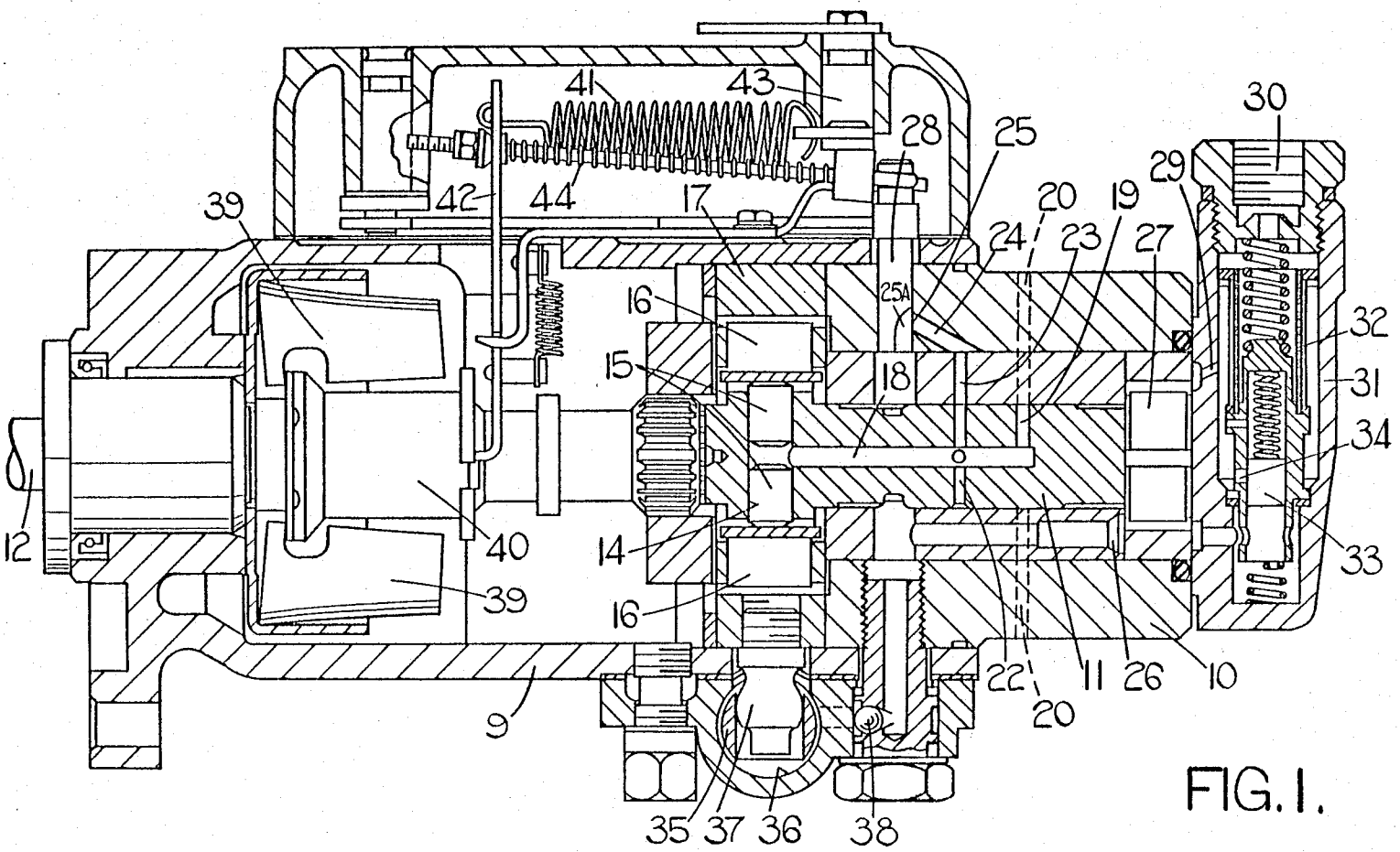
FIG. 1 is an axial cross sectional view of a side elevation of a known form of apparatus.

Referring to FIG. 1 of the drawings the apparatus comprises a body part which is formed in two parts 9 and 10, the part 10 being located within the end of the part 9. Formed within the part 10 is a bore in which is mounted a rotary cylindrical distributor member 11 which is coupled to an input shaft 12 carried in the part 9 of the body and which is adapted to be driven in timed relationship with an engine with which the apparatus is associated. Formed within the distributor member is a transverse bore 14 in which is mounted a pair of reciprocable plungers 15 which are arranged to be moved outwardly as the distributor member rotates, through the intermediary of a pair of rollers 16 respectively, by cam lobes (not shown) formed on an annular cam ring 17 which is mounted for angular movement within the part 9 of the body.

Also formed in the distributor member is a longitudinally extending passage 18 which at one end is in communication with the transverse bore 14 and which at its other end communicates with a radially disposed delivery passage 19. The passage 19 is arranged to register in turn with a plurality of equi-angularly spaced delivery ports 20 which in use, are connected to the injection nozzles respectively of the associated engine. The registration of the passage 19 with one of the delivery ports takes place during the whole time the plungers 15 are being moved inwardly so that liquid fuel contained within the bore 14 and displaced by the plungers, will flow to an injection nozzle of the engine.

At another point the longitudinal passage 18 communicates with a plurality of inlet passages 22 which are arranged to register in turn with an inlet port 23 defined in the part 10 of the body. The inlet port 23 communicates with a control port 25 by way of a passage 24 and the control port 25 is formed in the wall of a drilling which contains an angularly movable throttle member 28. The effective size of the control port 25 is varied by varying the angular setting of the throttle member which has a groove **25*a* formed therein, the groove 25*a* at its end, being in constant communication with the outlet 26 of a low pressure feed pump 27. A passage 22 is brought into communication with the port 23, during the time when the plungers can move outwardly and whilst such communication is established, fuel flows from the outlet 26 of the feed pump to the bore 14, the quantity of fuel flowing being determined by the angular setting of the throttle member 28**.

The pump 27 is provided with an inlet which is in communication with an inlet port 30 formed in a hollow part 31 which is secured to the part 10 of the body. The inlet of the low pressure pump communicates with the inlet 30 by way of a passage 29 and the part 31 also carries a filter 32 and a relief valve which includes a spring loaded element 33. One end of the element is exposed to the outlet pressure of the pump 27 and it is biased by a spring against the force exerted by the aforesaid pressure. The element 33 moves under the action of the pressure to control the size of a port 34. The arrangement is such that the outlet pressure of the pump 27 varies in accordance with the speed at which the apparatus is driven.

The cam ring as previously mentioned, is angulary adjustable and for this purpose it is provided with a radially disposed peg 37 which is coupled to a piston 35 slidable within a cylinder 36. The piston 35 is spring loaded in a direction so that the delivery of fuel by the apparatus is retarded and the piston is moved in the opposite direction by fuel under pressure from the aforesaid pump 27. A check valve 38 is provided in the passage between the outlet 26 of the pump 27 and the cylinder 36 and which closes to prevent fuel passing from the cylinder to the supply passage due to the interaction of the rollers 16 with the cam lobes. The fit of the piston within the cylinder 36 is such as to permit leakage to occur so that when the outlet pressure of the pump 27 falls, the piston will be able to move under the action of its spring.

The angular setting of the throttle member is controlled by a mechanical governor which includes weights 39 accommodated in a cage driven by the shaft 12. The weights act upon an axially movable flanged collar 40 mounted about the drive shaft 12 and the axial movement of the collar is resisted by means of a governor spring 41 which is mounted between one end of a pivotal lever 42 and an operator adjustable member 43. The other end of the lever 42 bears against the collar and the one end of the lever is coupled by means of a tie rod 44 to an arm extending from the throttle member. The arrangement is such that as the speed of rotation of the engine increases, the collar 40 will be moved axially against the action of the spring to impart angular movement to the throttle member 28 in a direction to reduce the degree of registration of the groove 25*a* with the port 25 and hence reduce the amount of fuel which is supplied to the associated engine. If the force exerted by the governor spring 41 is increased then the weights will be moved inwardly and the throttle member will be moved angularly to increase the degree of registration of the groove and port thereby increasing the amount of fuel supplied to the engine.

Figure 2:
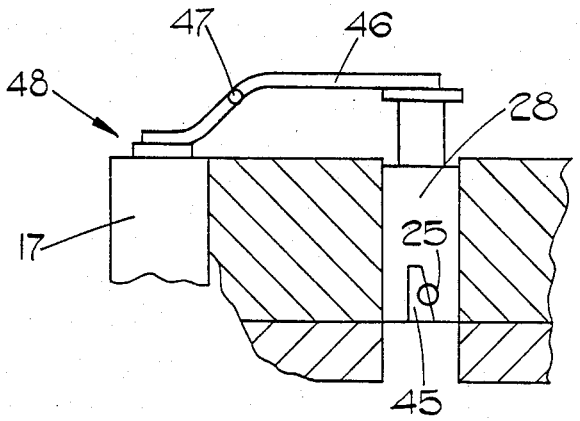
FIG. 2 is a cross-sectional view of a modification to part of the apparatus seen in FIG. 1.
Figure 3:
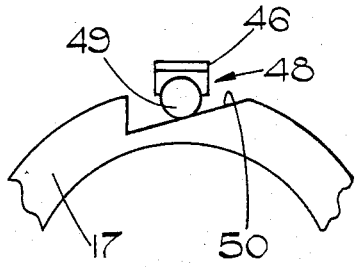
FIG. 3 is an end view from the left of the modification seen in FIG. 2.

In order to vary the maximum amount of fuel which can be supplied to the engine in accordance with the engine speed, the apparatus as described is modified as shown in FIGS. 2 and 3.

With reference to FIG. 2 the throttle member 28 is indicated but in this case the groove 45 therein has a different configuration to the groove 25*a*. First of all it should be mentioned that the groove 45 and the port 25 have been displaced for the purpose of facilitating the explanation. As will be observed one side of the groove 45 is inclined to the axis of the drilling in which the throttle member is located and as a result upon axial movement of the throttle member 28 the degree of registration of the groove with the port will vary. If desired both sides of the groove may be inclined to facilitate manufacture. The end of the member 28 contacts a pivotal lever 46 which is mounted about a pivot 47 and the opposite end of the lever engages a cam follower generally indicated at 48 and which includes a roller 49. The roller 49 is engageable with a cam surface 50 formed in the external peripheral surface on the cam ring 17, and axis of the roller being parallel to the axis for the cam ring and the roller being maintained in contact with the cam surface by the pressure of fuel acting on the end of the throttle member.

As shown in FIG. 3, the cam ring is in an intermediate position and as the outlet pressure of the pump 27 increases, the cam ring 17 will move in the clockwise direction and hence the lever 46 will pivot to permit the throttle member 28 to move further outwardly under the action of the outlet pressure of the pump 27 applied to its end remote from the lever. This will permit an increased quantity of fuel to flow to the associated engine for a given angular setting of the throttle member. The cam surface 50 may be of a different contour to obtain other maximum fuel characteristics. For example, it can be arranged that the curve of maximum fuel delivery has a dip at low engine speeds. This characteristic is particularly useful for turbocharged engines where at low engine speed, the turbo charger is not effective to supply air at any appreciable pressure.

The arrangement as described has an advantage over the arrangement described in the Specification of British Pat. No. 1171791 in that there is little side load applied to the throttle member. Side load on the throttle member can cause the throttle member to stick and can cause excessive wear of the throttle member and the bore in which it is located.

We claim:

1. A liquid fuel injection pumping apparatus for supplying fuel to internal combustion engines comprising; a body part, a bore and a plunger reciprocable in the bore, a cam ring rotatably mounted in the body part having a cam lobe operably associated with the plunger for imparting inward movement to the plunger to pump fuel through a conduit to an outlet, a low pressure pump having an outlet connected to the plunger bore for supplying fuel to said bore during the filling stroke of the apparatus, valve means for controlling the outlet pressure of the pump so that it varies in accordance with the speed at which the apparatus is driven, a fluid pressure operable device responsive to the outlet pressure of the pump and operably associated with the cam ring for controlling the angular setting of said cam ring, a throttle bore in said body part, an angularly adjustable throttle member mounted in said throttle bore, a groove on the peripheral surface of the throttle member and a port opening into the throttle bore at said groove, said port and groove constituting part of the flow conduit for fuel between the outlet of the pump and the plunger bore, means to vary the degree of registration of the groove and the port by altering the angular setting of the throttle member thereby to vary the quantity of fuel supplied to the plunger bore, at least one side edge of said groove being inclined to the axis of the throttle bore so that the degree of registration of the groove with the port will vary as the axial position of the throttle member is varied, a pivotal lever one end of which operatively engages said throttle member to serve as a stop to control the axial setting of the throttle member, a cam surface formed on the cam ring, a cam follower operatively engaging said cam surface, and the other end of said lever operatively engages said cam follower so that the axial setting of the throttle member can be varied by angular movement of the cam ring.

2. An apparatus according to claim 1 wherein fuel under pressure from said low pressure pump outlet acts upon an end surface of the throttle member to urge the throttle member into engagement with said one end of the lever.

3. An apparatus according to claim 1 wherein said cam surface is formed on the external peripheral surface of the cam ring.

4. An apparatus according to claim 3 wherein said cam follower comprises a roller the axis of which extends parallel to the axis of the cam ring.

5. An apparatus according to claim 1 wherein a rotary distributor member is provided in said body member and said plunger bore is formed in said rotary distributor member.

6. An apparatus according to claim 2 wherein said cam surface is formed on the external peripheral surface of the cam ring.

7. An apparatus according to claim 6 wherein said cam follower comprises a roller the axis of which extends parallel to the axis of the cam ring.

8. In a liquid fuel injection pumping apparatus for supplying fuel to internal combustion engines including a casing, a rotary cylindrical distributor rotatably mounted within said cylinder, an input shaft rotatably mounted in said casing and coupled to said distributor to rotate said distributor about its cylindrical axis, at least one radial bore in said distributor, at least one plunger reciprocable in each bore, a cam ring rotatably mounted in the casing, at least one cam lobe for imparting inward movement to each plunger to pump fuel through an outlet conduit, a low pressure pump having an outlet connected to the bore for supplying fuel to said bore during the filling stroke of the apparatus, valve means for controlling the outlet pressure of the low pressure pump so that it varies in accordance with the speed at which the apparatus is driven, a fluid pressure operable device responsive to the outlet pressure of the low pressure pump for controlling the angular setting of said cam ring, a throttle bore in said casing extending radially with respect to the axis of the rotary distributor, an angularly adjustable throttle member mounted in said throttle bore and a groove on the peripheral surface of the throttle member, a port opening into the throttle bore, said port and groove constituting part of the flow path for fuel between the outlet of the low pressure pump and said plunger bore and the degree of registration of the groove and the port being varied by altering the angular setting of the throttle member thereby to vary the quantity of fuel supplied to the plunger bore, the improvement comprising:

said throttle member is movable radially with respect to said axis of the rotary distributor;

said groove extends substantially axially in said throttle member;

at least one side edge of said groove is inclined with respect to the axis of said throttle bore so that the degree of registration of said groove with said port will vary as the radial position of said throttle member is varied;

a lever pivotally mounted between its ends;

one end of said lever operatively engaging said throttle member to limit the radially outer setting thereof;

a cam surface on said cam ring;

a cam follower operatively engaging said cam surface; and the other end of said lever operatively engaging said cam follower so that the radial setting of said throttle member is varied according to the speed at which the apparatus is driven by the angular movement of said cam ring.

9. An apparatus as claimed in claim 8 wherein said cam surface comprises:

a notch in the outer periphery of said cam ring having a planar surface extending from said outer periphery inwardly thereof at an angle to a radius of said cam ring.

10. An apparatus as claimed in claim 8 wherein:

said inclined edge of said groove is inclined in a direction so that the groove is narrower in the radially outward direction of the throttle member so that radially outward movement of said throttle member allows greater flow of fuel through said groove and port.

11. An apparatus as claimed in claim 13 wherein:

the radially inner end of said throttle member is in contact with fuel under said outlet pressure of said low pressure pump so that said throttle member is urged radially outwardly thereby against said one end of said lever.

12. An apparatus as claimed in claim 11 wherein:

said cam follower comprises a roller having its rotational axis parallel to the central axis of said cam ring; and said cam ring is co-axial with said rotary distributor.

13. In a liquid fuel injection pumping apparatus for supplying fuel to internal combustion engines including a casing, a rotary cylindrical distributor rotatably mounted within said cylinder, an input shaft rotatably mounted in said casing and coupled to said distributor to rotate said distributor about its cylindrical axis, at least one radial bore in said distributor, at least one plunger reciprocable in each bore, a cam ring rotatably mounted in the casing, at least one cam lobe for imparting inward movement to each plunger to pump fuel through an outlet conduit, a low pressure pump having an outlet connected to the bore for supplying fuel to said bore during the filling stroke of the apparatus, valve means for controlling the outlet pressure of the low pressure pump so that it varies in accordance with the speed at which the apparatus is driven, a fluid pressure operable device responsive to the outlet pressure of the low pressure pump for controlling the angular setting of said cam ring, a throttle bore in said casing extending radially with respect to the axis of the rotary distributor, an angularly adjustable throttle member mounted in said throttle bore and a groove on the peripheral surface of the throttle member, a port opening into the throttle bore, said port and groove constituting part of the flow path for fuel between the outlet of the low pressure pump and said plunger bore and the degree of registration of the groove and the port being varied by altering the angular setting of the throttle member thereby to vary the quantity of fuel supplied to the plunger bore, the improvement comprising:

said throttle member is movable radially with respect to said axis of the rotary distributor;

said groove extends substantially axially in said throttle member;

at least one side edge of said groove is inclined with respect to the axis of said throttle bore in a direction so that the groove is narrower in the radially outward direction of the throttle member to allow greater flow of fuel through said groove and port by radially outward movement of said throttle member which varies the degree of registration of said groove with said port; and means to vary said radial position of said throttle member according to the speed at which the apparatus is driven.

* * * * *